US010433616B2

(12) United States Patent
Takeshita et al.

(10) Patent No.: US 10,433,616 B2
(45) Date of Patent: Oct. 8, 2019

(54) SOLE STRUCTURE FOR SHOES

(71) Applicant: MIZUNO CORPORATION, Osaka-shi, Osaka (JP)

(72) Inventors: Takeshi Takeshita, Osaka (JP); Tatsuya Dazai, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 490 days.

(21) Appl. No.: 15/172,863

(22) Filed: Jun. 3, 2016

(65) Prior Publication Data

US 2016/0353838 A1 Dec. 8, 2016

(30) Foreign Application Priority Data

Jun. 5, 2015 (JP) ..... 2015-114386

(51) Int. Cl.

| | |
|---|---|
| ***A43B 13/18*** | (2006.01) |
| ***A43B 13/04*** | (2006.01) |
| ***A43B 13/42*** | (2006.01) |
| ***A43B 13/12*** | (2006.01) |

(52) U.S. Cl.

CPC ..... *A43B 13/186* (2013.01); *A43B 13/04* (2013.01); *A43B 13/125* (2013.01); *A43B 13/188* (2013.01); *A43B 13/42* (2013.01)

(58) Field of Classification Search

CPC ..... A43B 13/186; A43B 13/04; A43B 13/125; A43B 7/141; A43B 7/08; A43B 13/188; A43B 13/42; A43B 13/18; A43B 13/14; A43B 13/00; A43B 13/181

USPC ..... 36/25 R, 103, 31, 91, 107

See application file for complete search history.

(56) References Cited

U.S. PATENT DOCUMENTS

| | | | | |
|---|---|---|---|---|
| 3,834,046 A * | 9/1974 | Fowler | ..... | A43B 13/181 36/28 |
| 4,663,865 A * | 5/1987 | Telecemian | ..... | A43B 13/181 36/114 |
| 5,046,267 A * | 9/1991 | Kilgore | ..... | A43B 5/00 36/114 |

(Continued)

FOREIGN PATENT DOCUMENTS

| | | |
|---|---|---|
| JP | H1142103 A | 2/1999 |
| JP | 3403952 B2 | 5/2003 |

(Continued)

OTHER PUBLICATIONS

English Translation of Office Action for Japanese Application No. 2015-114386, dated Aug. 25, 2016, 3 pages.

*Primary Examiner* — Alissa J Tompkins
*Assistant Examiner* — Catherine M Ferreira
(74) *Attorney, Agent, or Firm* — Troutman Sanders LLP; Daniel Sharpe

(57) ABSTRACT

A sole structure for shoes includes a midsole and a plate member made of a hard resin harder than the midsole, which is joined to a lower surface of the midsole. The plate member includes a first reinforcement portion extending rearwardly from a position corresponding to a portion in the rear of a thenar of a user along a medial side arch region and a second reinforcement portion extending rearwardly on a lateral side from the position corresponding to the portion in the rear of the thenar of the user so as to avoid a position corresponding to a portion more frontward than a center of a fifth metatarsal bone.

12 Claims, 6 Drawing Sheets

(56) References Cited

U.S. PATENT DOCUMENTS

| | | | | |
|---|---|---|---|---|
| 5,311,674 | A * | 5/1994 | Santiyanont | A43B 21/26 36/28 |
| 5,647,145 | A * | 7/1997 | Russell | A43B 3/0052 36/25 R |
| 6,199,302 | B1 * | 3/2001 | Kayano | A43B 7/24 36/144 |
| 6,199,303 | B1 * | 3/2001 | Luthi | A43B 7/142 36/107 |
| 8,973,290 | B2 * | 3/2015 | Howley | A43B 13/14 36/126 |
| 9,149,087 | B2 * | 10/2015 | Abshire | A43B 7/1425 |
| D746,031 | S * | 12/2015 | Smith | D2/951 |
| 9,591,891 | B1 * | 3/2017 | Baucom | A43B 13/14 |
| 2003/0005600 | A1 * | 1/2003 | Kita | A43B 7/142 36/76 R |
| 2006/0137228 | A1 * | 6/2006 | Kubo | A43B 3/0036 36/103 |
| 2010/0293811 | A1 * | 11/2010 | Truelsen | A43B 5/06 36/28 |
| 2011/0197468 | A1 | 8/2011 | Kubo et al. | |
| 2012/0180343 | A1 * | 7/2012 | Auger | A43B 5/02 36/30 R |

FOREIGN PATENT DOCUMENTS

| | | | |
|---|---|---|---|
| JP | 2007089734 | A | 4/2007 |
| WO | WO2005/037002 | A1 | 4/2005 |

* cited by examiner

SOLE STRUCTURE FOR SHOES

This nonprovisional application is based on Japanese Patent Application No. 2015-114386 filed with the Japan Patent Office on Jun. 5, 2015, the entire contents of which are hereby incorporated by reference.

BACKGROUND OF THE INVENTION

Field of the Invention

The present invention relates to a sole structure for shoes and particularly to a sole structure for shoes including a midsole and a plate member made of a hard resin.

Description of the Background Art

A sole structure for shoes including a midsole and a plate made of a material harder than the midsole (a plate member made of a hard resin) has conventionally been known (Japanese Patent No. 3403952). The plate of the sole structure for shoes in Japanese Patent No. 3403952 is constituted of a corrugated heel portion provided under a heel, a medial side portion extending forward from a medial side front end of the heel portion of the plate along a medial side, and a lateral side portion extending forward from a lateral side front end of the heel portion of the plate along a lateral side. Such a plate holds an arch of a foot of a user.

SUMMARY OF THE INVENTION

A user of shoes who plays sport performs actions to land on the lateral side of the heel, move the center of gravity from the heel to the forefoot portion, and thereafter kick the ground at the forefoot portion, for example, in running. A user of other shoes performs actions to land on the lateral side of the metatarsus portion, move the center of gravity from the metatarsus portion to the forefoot portion, and thereafter kick the ground at the forefoot portion, for example, in running. In particular, it is said that more users who run at a high speed tend to land on the lateral side of the metatarsus portion.

When a user who lands on the lateral side of the metatarsus portion runs in shoes provided with the sole structure described in Japanese Patent No. 3403952, the user lands on a position corresponding to the lateral portion of the plate, and hence the user may feel uncomfortable due to the presence of the plate.

The present invention was made to solve the problem above, and an object thereof is to provide a sole structure for shoes which can be less likely to cause uncomfortableness even when a user lands on a lateral side of a metatarsus portion in running while an arch of the user is sufficiently held.

In order to solve the problem above, a sole structure for shoes according to one invention of the present invention includes a midsole and a plate member made of a hard resin harder than the midsole, which is joined to a lower surface of the midsole, and the plate member includes a first reinforcement portion extending rearwardly from a position corresponding to a thenar of a user or a portion in the rear of the thenar along a medial side arch and a second reinforcement portion extending rearwardly on a lateral side from the position corresponding to the thenar of the user or the portion in the rear of the thenar so as to avoid a position corresponding to a portion more frontward than a center of a fifth metatarsal bone. Here, the position corresponding to the portion in the rear of the thenar of the user refers to a position corresponding to any position in a range from a portion immediately in the rear of the thenar of the user to a portion in the vicinity of an arch front side of the user.

With the sole structure for shoes according to one invention, as described above, the medial side of the arch of the user can be held by providing the plate member with the first reinforcement portion extending rearwardly from the position corresponding to the thenar of the user or the portion in the rear of the thenar along the medial side arch. Since torsional rigidity can be improved by the first reinforcement portion and the second reinforcement portion extending in directions intersecting with each other by providing the plate member with the second reinforcement portion together with the first reinforcement portion, the second reinforcement portion extending rearwardly on the lateral side from the position corresponding to the thenar of the user or the portion in the rear of the thenar, deformation of the sole in a direction of torsion can moderately be suppressed. By providing the second reinforcement portion so as to avoid the position corresponding to the portion more frontward than the center of the fifth metatarsal bone, even a user who lands on the position corresponding to the lateral portion of the metatarsal portion is free from uncomfortableness resulting from presence of the plate member, because there is no second reinforcement portion at the position corresponding to the portion more frontward than the center of the fifth metatarsal bone located as protruding at the surface of the bottom of the foot. Thus, even when the user lands on the lateral side of the metatarsal portion in running, uncomfortableness can be less likely while the arch of the user is sufficiently held.

A sole structure for shoes according to another invention of the present invention includes a midsole and a plate member made of a hard resin harder than the midsole, which is joined to a lower surface of the midsole, and the plate member includes a first reinforcement portion extending from a position corresponding to a first metatarsal bone caput of a user or a portion in the rear of the first metatarsal bone caput along a medial side arch at least to a position corresponding to a navicular and a second reinforcement portion extending from the position corresponding to the first metatarsal bone caput of the user or the portion in the rear of the first metatarsal bone caput at least to a position corresponding to a cuboid so as to avoid a position corresponding to a portion more frontward than a center of a fifth metatarsal bone. Here, the position corresponding to the portion in the rear of the first metatarsal bone caput of the user refers to a position corresponding to any position in a range from a portion immediately in the rear of the first metatarsal bone caput of the user to a portion in the vicinity of an arch front side of the user.

With the sole structure for shoes according to another invention, as described above, the medial side of the arch of the user can be held by providing the plate member with the first reinforcement portion extending from the position corresponding to the first metatarsal bone caput of the user or the portion in the rear of the first metatarsal bone caput at least to the position corresponding to the navicular along the medial side arch. Since torsional rigidity can be improved by the first reinforcement portion and the second reinforcement portion extending in directions intersecting with each other by providing the plate member with the second reinforcement portion together with the first reinforcement portion, the second reinforcement portion extending from the position corresponding to the first metatarsal bone caput of the user or the portion in the rear of the first metatarsal bone caput at least to the position corresponding to the cuboid, deformation of the sole in a direction of torsion can moderately be suppressed. By providing the second reinforcement portion so as to avoid the position corresponding to the portion more frontward than the center of the fifth metatarsal bone, even a user who lands on the position corresponding to the lateral portion of the metatarsal portion is free from uncomfortableness resulting from presence of the plate member, because there is no second reinforcement portion at the position corresponding to the portion more frontward than the center of the fifth metatarsal bone located as protruding at the surface of the bottom of the foot. Thus, even when the user lands on the lateral side of the metatarsal portion in running, uncomfortableness can be less likely while the arch of the user is sufficiently held. In the sole structure for shoes according to one invention and another invention, preferably, the first reinforcement portion and the second reinforcement portion each have a substantially U-shape or a substantially V-shape projecting downward in a cross-sectional view in a direction of width of a foot. With the construction as such, rigidity can be improved with increase in weight of the first and second reinforcement portions being suppressed, and therefore the arch of the user can sufficiently be held while the sole is reduced in weight.

In the sole structure for shoes according to one invention and another invention, preferably, a height difference between a highest point and a lowest point in a prescribed cross-sectional view of the first reinforcement portion in a direction of width of a foot may be not smaller than 2 mm and a height difference between a highest point and a lowest point in a prescribed cross-sectional view of the second reinforcement portion in a direction of width of a foot may be not smaller than 2 mm.

In the sole structure for shoes according to one invention and another invention, preferably, the plate member further includes a third reinforcement portion provided between the first reinforcement portion and the second reinforcement portion and connecting a lateral side end portion of the first reinforcement portion and a medial side end portion of the second reinforcement portion to each other. With the construction as such, rigidity in the direction of torsion can further be improved.

In this case, preferably, the third reinforcement portion is in a form of a substantially flat surface and has an upper surface bonded to the lower surface of the midsole. With the construction as such, an area of bonding can be increased, and therefore separation of the plate member from the midsole can be suppressed as compared with a case that the third reinforcement portion is not bonded to the midsole.

In the sole structure for shoes according to one invention and another invention, preferably, the plate member may have front and rear end portions joined to respective outsoles which come in contact with a road surface.

According to the sole structure for shoes according to the present invention, uncomfortableness can be less likely even when a user lands on a lateral side of a metatarsus portion in running while an arch of the user is sufficiently held.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A sole structure 1 for shoes according to one embodiment of the present invention will be described with reference to FIGS. 1 to 6.

Figure 1:
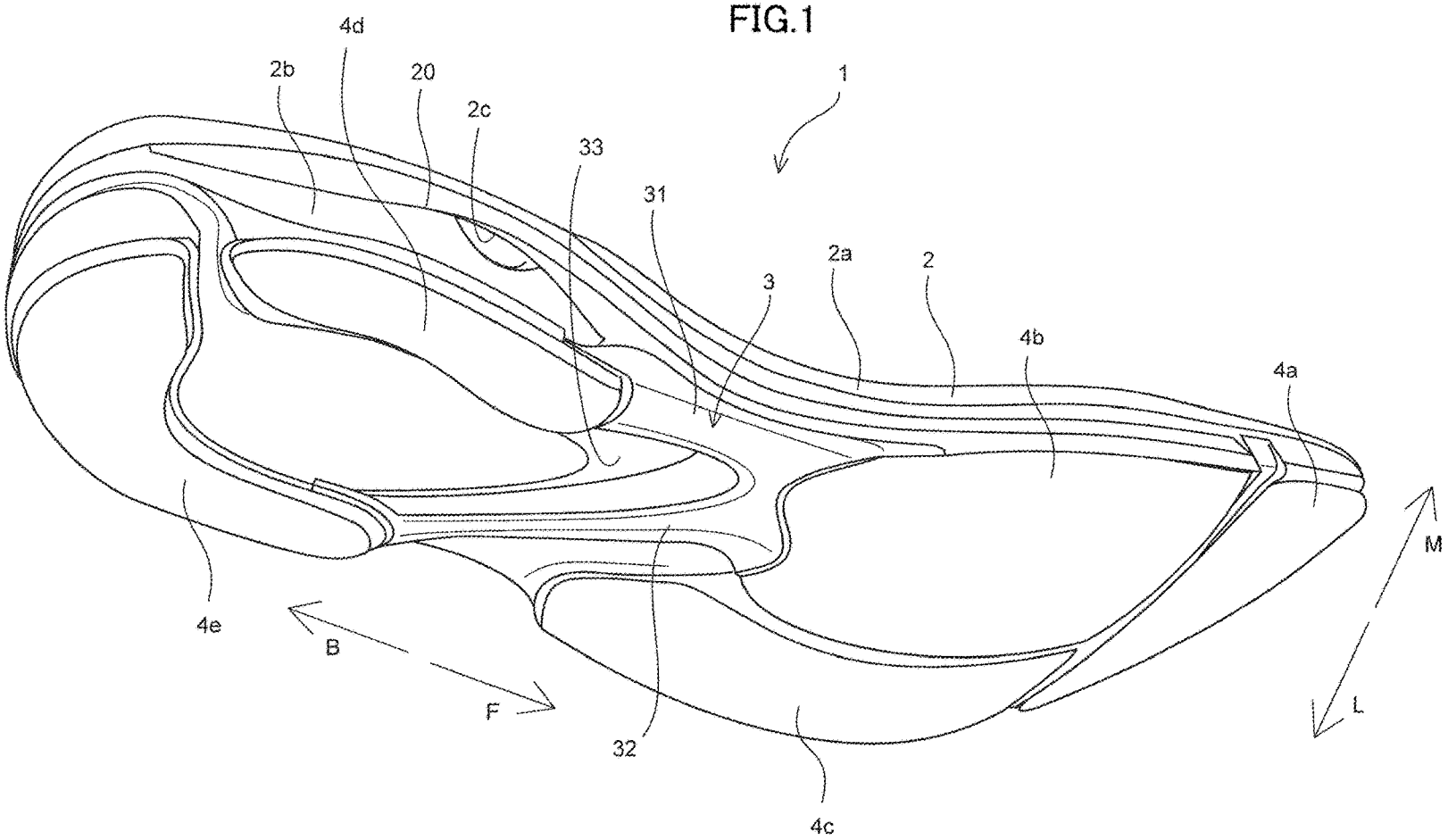
FIG. 1 is an overall perspective view of a sole structure for shoes according to one embodiment of the present invention.
Figure 2:
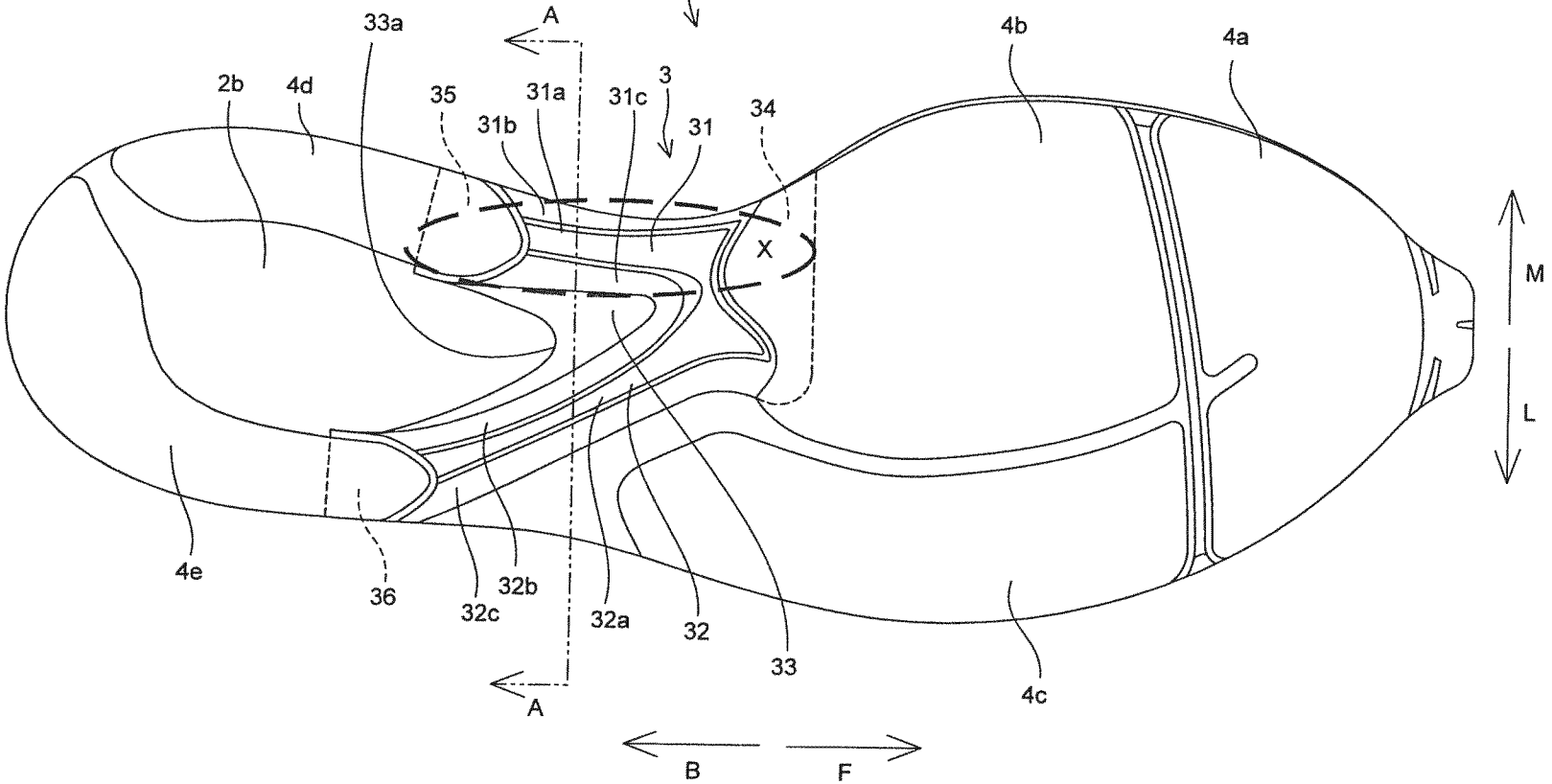
FIG. 2 is a bottom view of the sole structure for shoes in FIG. 1.

As shown in FIGS. 1 and 2, sole structure 1 for shoes includes a midsole 2, a plate member 3 made of a hard resin harder than midsole 2, which is joined to a lower surface of midsole 2, and a plurality of outsoles 4*a* to 4*e* for plate member 3 joined to the lower surface of midsole 2.

Midsole 2 is formed from a soft elastic member. For example, midsole 2 is composed of a thermoplastic resin such as an ethylene-vinyl acetate copolymer (EVA) or a foam thereof, a thermosetting resin such as polyurethane (PU) or a foam thereof, or a rubber material such as butadiene rubber or chloroprene rubber or a foam thereof. Midsole 2 has a midsole main body portion 2*a* extending from a forefoot portion to a heel portion and a heel midsole portion 2*b* provided in the heel portion and provided below midsole main body portion 2*a* as shown in FIGS. 1 and 3.

Figure 3:
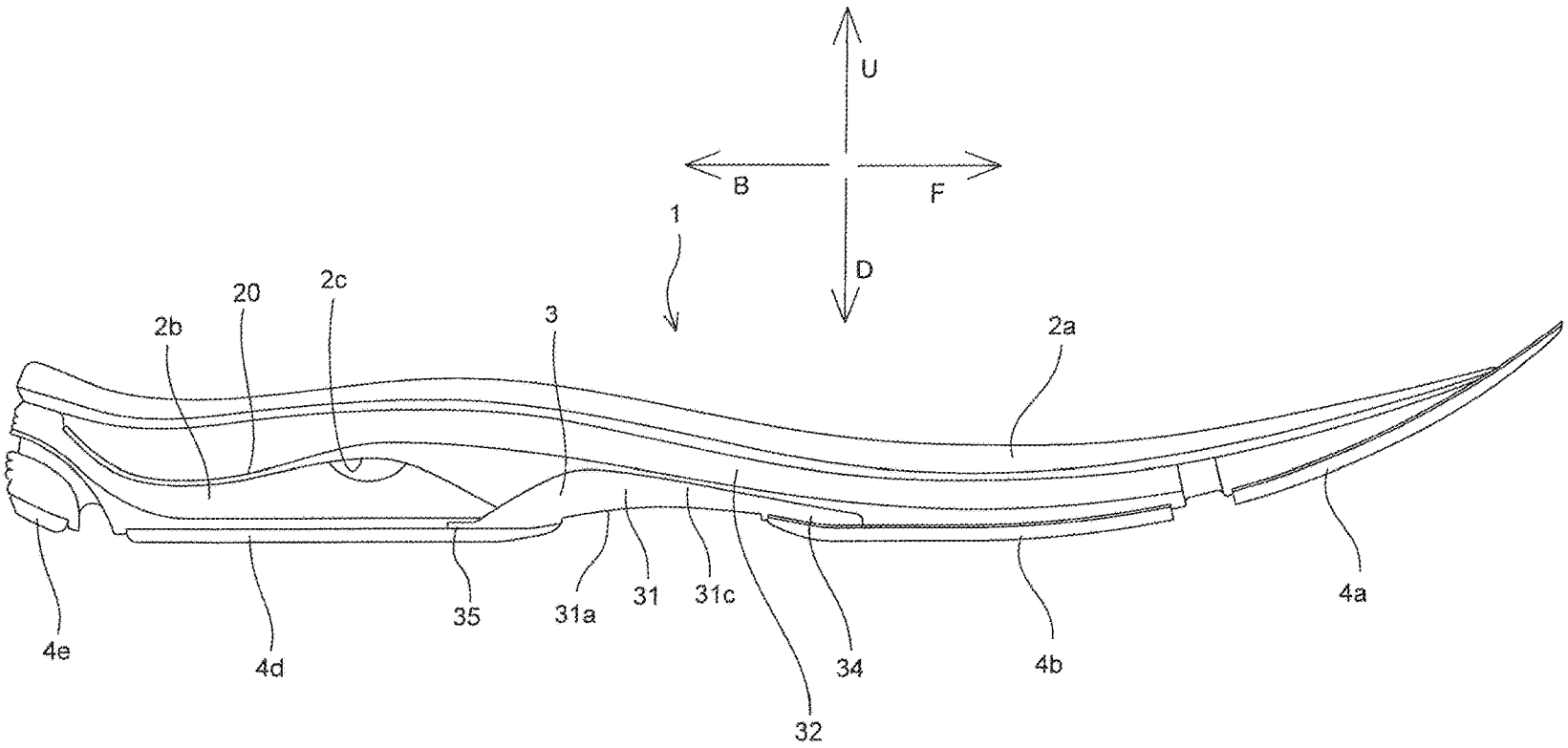
FIG. 3 is a side view showing a medial side of the sole structure for shoes in FIG. 1.

Midsole main body portion 2*a* and heel midsole portion 2*b* are separate from each other at a wavy boundary 20 extending in a front-rear direction as shown in FIG. 3, and an opening 2*c* for improving cushioning is provided in a part of boundary 20. A not-shown corrugated plate made of a resin is introduced in boundary 20. This not-shown corrugated plate made of a resin is formed separately from plate member 3. The corrugated plate made of a resin may be formed integrally with plate member 3. Plate member 3 and the corrugated plate made of a resin are composed, for example, of a thermoplastic resin such as a solid ethylene-vinyl acetate copolymer (EVA), polyamide elastomer (PAE), or polyurethane (TPU), a thermosetting resin such as polyurethane, or a rubber material such as solid rubber.

Figure 4:
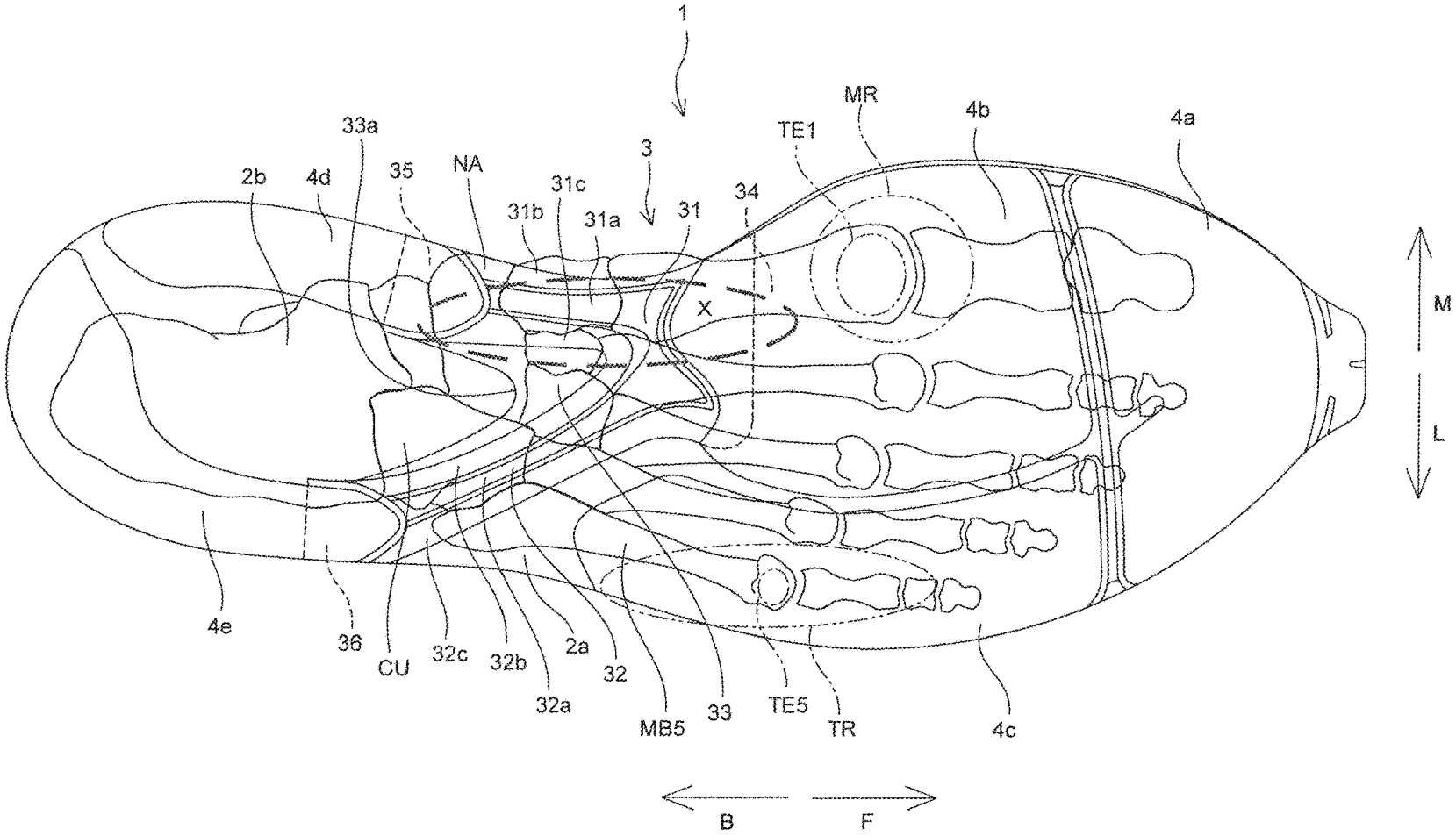
FIG. 4 is a diagram showing a skeleton being superimposed on the bottom view in FIG. 2.

In the present embodiment, as shown in FIG. 4, plate member 3 includes a first reinforcement portion 31 extending rearwardly (in a direction shown with an arrow B) from a position corresponding to a portion in the rear (a side in the direction shown with arrow B) of a thenar MR in the vicinity of an arch front side of a user along a medial side arch region X and a second reinforcement portion 32 extending rearwardly on the lateral side (a side in a direction shown with an arrow L) from the position corresponding to the portion in the rear of thenar MR of the user. In other words, plate member 3 includes first reinforcement portion 31 extending from a position corresponding to a portion in the rear of a first metatarsal bone caput TE in the vicinity of the arch front side of the user along medial side arch region X to a position corresponding to a navicular NA and second reinforcement portion 32 extending from a position corresponding to the portion in the rear of first metatarsal bone caput TE of the user to a position corresponding to a cuboid CU.

In the present embodiment, second reinforcement portion 32 is constructed to avoid a position corresponding to a portion more frontward (a direction shown with an arrow F) than a center of a fifth metatarsal bone MB5 of the user. Namely, the user is less likely to feel stiffness of plate member 3 at a fifth metatarsal bone caput TE5 of the user and a portion in the vicinity thereof when the user lands on the lateral side (a region TR) of the metatarsal portion, and in the present embodiment, cushioning by midsole 2 can sufficiently be obtained.

As shown in FIG. 2, plate member 3 further includes a third reinforcement portion 33 provided between first reinforcement portion 31 and second reinforcement portion 32, a front end portion 34 provided in front of first reinforcement portion 31 and second reinforcement portion 32, a first rear end portion 35 provided at a rear end of first reinforcement portion 31, and a second rear end portion 36 provided at a rear end of second reinforcement portion 32.

Figure 5:
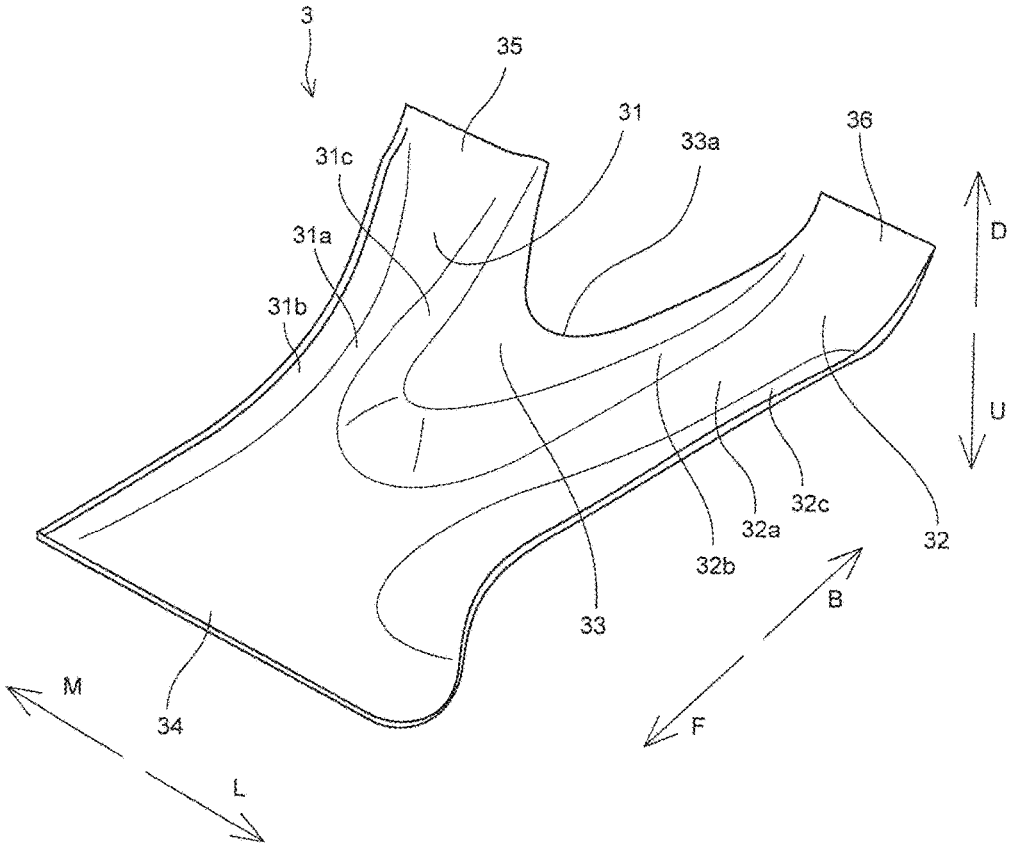
FIG. 5 is a perspective view showing a plate member of the sole structure for shoes in FIG. 1.
Figure 6:
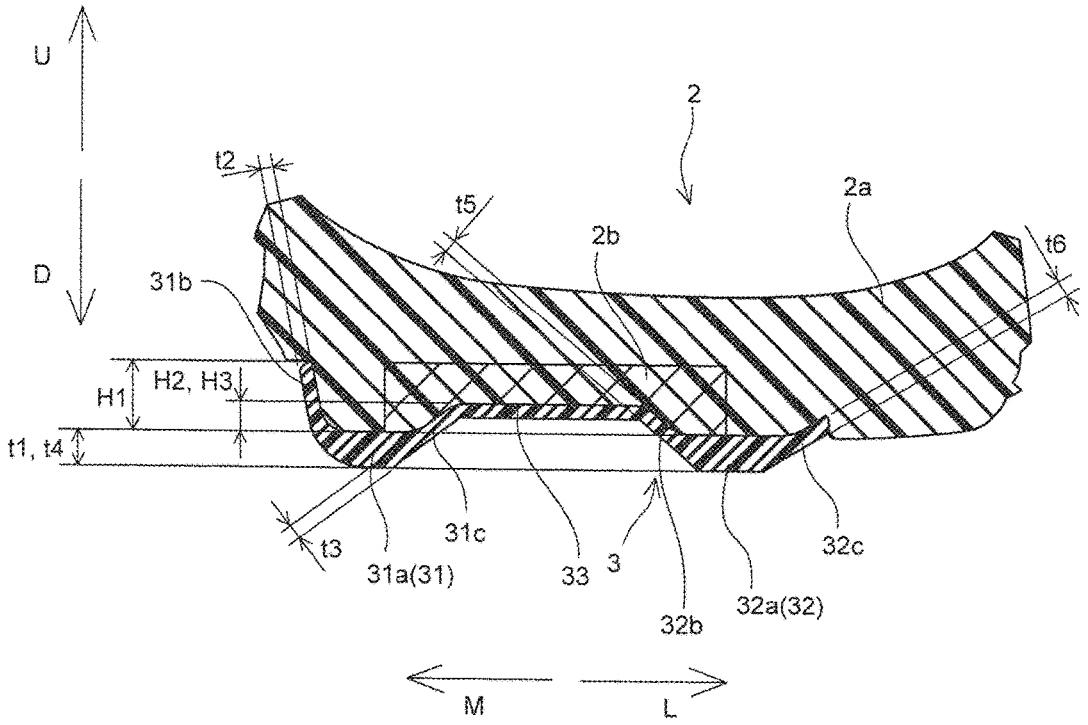
FIG. 6 is a cross-sectional view along A-A in FIG. 2.

First reinforcement portion 31 and second reinforcement portion 32 are connected to each other in the portion in the rear of thenar MR (see FIG. 4). As shown in FIG. 6, first reinforcement portion 31 and second reinforcement portion 32 have a substantially U-shape projecting downward (in a direction shown with an arrow D) in a cross-sectional view in a direction of width of a foot (a direction shown with an arrow ML). Specifically, as shown in FIGS. 5 and 6, first reinforcement portion 31 includes a bottom surface portion 31*a* forming a bottom surface of the U-shape, a medial side surface portion 31*b* forming a side surface on a medial side (a side in a direction shown with an arrow M) of the U-shape, and a lateral side surface portion 31*c* forming a side surface on a lateral side (a side in the direction shown with arrow L) of the U-shape. Second reinforcement portion 32 includes a bottom surface portion 32*a* forming a bottom surface of the U-shape, a medial side surface portion 32*b* forming a side surface on a medial side of the U-shape, and a lateral side surface portion 32*c* forming a side surface on a lateral side of the U-shape.

As shown in FIG. 6, bottom surface portion 31*a* is formed to be greater in thickness than medial side surface portion 31*b* and lateral side surface portion 31*c*. Specifically, bottom surface portion 31*a* has a thickness t1 of approximately 3 mm, and medial side surface portion 31*b* and lateral side surface portion 31*c* have respective thicknesses t2 and t3 of approximately 1.2 mm. Bottom surface portion 31*a* has an upper surface formed from a substantially flat surface. Bottom surface portion 31*a* thus achieves improved adhesiveness to midsole main body portion 2*a* arranged on the upper surface of bottom surface portion 31*a*. Medial side surface portion 31*b* protrudes upward (in a direction shown with an arrow U) so as to incline from bottom surface portion 31*a* toward the medial side (the side in the direction shown with arrow M). Medial side surface portion 31*b* is arranged such that at least a part thereof covers a side surface of midsole main body portion 2*a*. Lateral side surface portion 31*c* protrudes upward so as to incline from bottom surface portion 31*a* toward the lateral side (the side shown with arrow L).

A height difference between a highest point and a lowest point of the upper surface in a cross-sectional view of first reinforcement portion 31 in the direction of width of the foot, that is, a height difference H1 between an upper end point of medial side surface portion 31*b* and the upper surface of bottom surface portion 31*a* is approximately 4 mm. Torsional rigidity of plate member 3 is appropriate so long as height difference H1 is within a range from 1 mm to 10 mm. A height difference H2 between the upper surface of bottom surface portion 31*a* and an upper end point of lateral side surface portion 31*c* is approximately 2 mm.

Bottom surface portion 32*a* is formed to be greater in thickness than medial side surface portion 32*b* and lateral side surface portion 32*c*. Specifically, bottom surface portion 32*a* has a thickness t4 of approximately 3 mm and medial side surface portion 32*b* and lateral side surface portion 32*c* have respective thicknesses t5 and t6 of approximately 1.2 mm. Bottom surface portion 32*a* has the upper surface formed from a substantially flat surface. Thus, bottom surface portion 32*a* has improved adhesiveness to midsole main body portion 2*a* and heel midsole portion 2*b* arranged on the upper surface of bottom surface portion 32*a*. Medial side surface portion 32*b* protrudes upward so as to incline from bottom surface portion 32*a* toward the medial side. Lateral side surface portion 32*c* protrudes upward so as to incline from bottom surface portion 32*a* toward the lateral side.

A height difference between a highest point and a lowest point of the upper surface in a cross-sectional view of second reinforcement portion 32 in the direction of width of the foot (a direction shown with an arrow LM), that is, a height difference H3 between the upper surface of bottom surface portion 32*a* and an upper end point of medial side surface portion 32*b* or an upper end point of lateral side surface portion 32*c* is approximately 2 mm.

As shown in FIGS. 5 and 6, third reinforcement portion 33 is constructed to connect an upper end of lateral side surface portion 31*c* of first reinforcement portion 31 and an upper end of medial side surface portion 32*b* of second reinforcement portion 32 to each other. Third reinforcement portion 33 is in a form of a substantially flat surface. Third reinforcement portion 33 has a notch portion 33*a* in a rear end portion. Notch portion 33*a* has a function to adjust torque of plate member 3 when load in a direction of torsion is applied to plate member 3. Third reinforcement portion 33 has the upper surface bonded to the lower surface of midsole 2 with an adhesive.

As shown in FIG. 2, front end portion 34 provided in front of first reinforcement portion 31 and second reinforcement portion 32 is joined to outsole 4*b* which comes in contact with a road surface. Specifically, front end portion 34 is in a form of a substantially flat surface as shown in FIGS. 2 and 5, and arranged to lie between the lower surface of midsole main body portion 2*a* and the upper surface of outsole 4*b*. Front end portion 34 is bonded to midsole main body portion 2*a* and outsole 4*b* with an adhesive.

First rear end portion 35 provided at the rear end of first reinforcement portion 31 is joined to outsole 4*d* which comes in contact with the road surface. Specifically, first rear end portion 35 is in a form of a substantially flat surface and arranged to lie between the lower surface of heel midsole portion 2*b* and the upper surface of outsole 4*d*. First rear end portion 35 is bonded to heel midsole portion 2*b* and outsole 4*d* with an adhesive.

Second rear end portion 36 provided at the rear end of second reinforcement portion 32 is joined to outsole 4*e* which comes in contact with the road surface.

Specifically, second rear end portion 36 is in a form of a substantially flat surface and arranged to lie between the lower surface of heel midsole portion 2*b* and the upper surface of outsole 4*e*. Second rear end portion 36 is bonded to heel midsole portion 2*b* and outsole 4*e* with an adhesive.

As set forth above, in the present embodiment, the medial side of the arch of the user can be held by providing plate member 3 with first reinforcement portion 31 extending rearwardly from the position corresponding to the portion in the rear of thenar MR of the user along medial side arch region X. Since torsional rigidity can be improved by first reinforcement portion 31 and second reinforcement portion 32 extending in directions intersecting with each other by providing plate member 3 with second reinforcement portion 32 together with first reinforcement portion 31, the second reinforcement portion extending rearwardly on the lateral side (on the side in the direction shown with arrow L) from the position corresponding to the portion in the rear of thenar MR of the user, deformation of the sole in a direction of torsion can moderately be suppressed. By providing second reinforcement portion 32 so as to avoid the position corresponding to the portion more frontward (the direction shown with arrow F) than the center of fifth metatarsal bone MB5, even a user who lands on the position corresponding to the lateral portion of the metatarsal portion is free from uncomfortableness resulting from presence of plate member 3, because there is no second reinforcement portion 32 at the position corresponding to the portion more frontward (the direction shown with arrow F) than the center of fifth metatarsal bone MB5 located as protruding at the surface of the bottom of the foot. Thus, even when the user lands on the lateral side (region TR) of the metatarsal portion in running, uncomfortableness can be less likely while the arch of the user is sufficiently held.

In the present embodiment, as set forth above, the medial side of the arch of the user can be held by providing plate member 3 with first reinforcement portion 31 extending from the position corresponding to the portion in the rear of first metatarsal bone caput TE1 of the user along medial side arch region X at least to the position corresponding to navicular NA. Since torsional rigidity can be improved by first reinforcement portion 31 and second reinforcement portion 32 extending in directions intersecting with each other by providing plate member 3 with second reinforcement portion 32 together with first reinforcement portion 31, the second reinforcement portion extending from the position corresponding to the portion in the rear of first metatarsal bone caput TE1 of the user at least to the position corresponding to cuboid CU, deformation of the sole in a direction of torsion can moderately be suppressed. By providing second reinforcement portion 32 so as to avoid the position corresponding to the portion more frontward (the direction shown with arrow F) than the center of fifth metatarsal bone MB5, even a user who lands on the position corresponding to the lateral portion of the metatarsal portion is free from uncomfortableness resulting from presence of plate member 3, because there is no second reinforcement portion 32 at the position corresponding to the portion more frontward (the direction shown with arrow F) than the center of fifth metatarsal bone MB5 located as protruding at the surface of the bottom of the foot. Thus, even when the user lands on the lateral side (region TR) of the metatarsal portion in running, uncomfortableness can be less likely while the arch of the user is sufficiently held.

It should be understood that the embodiment disclosed herein is illustrative and non-restrictive in every respect. The scope of the present invention is defined by the terms of the claims, rather than the description of the embodiment above, and includes any modifications within the scope and meaning equivalent to the terms of the claims.

For example, though an example in which the plate member is provided with the first reinforcement portion extending rearwardly from the position corresponding to the portion in the rear of thenar MR of the user along medial side arch region X is shown in the embodiment above, the present invention is not limited thereto. In the present invention, the first reinforcement portion extending rearwardly from a position corresponding to thenar MR of a user along medial side arch region X may be provided.

Though an example in which the plate member is provided with the first reinforcement portion extending from the position corresponding to the portion in the rear of first metatarsal bone caput TE1 of the user to the position corresponding to navicular NA along medial side arch region X has been shown in the embodiment, the present invention is not limited thereto. In the present invention, the first reinforcement portion extending from the position corresponding to first metatarsal bone caput TE1 of the user along medial side arch region X to the position corresponding to navicular NA may be provided. The first reinforcement portion may extend to a position beyond navicular NA.

Though an example in which the first reinforcement portion and the second reinforcement portion have a substantially U-shape projecting downward in a cross-sectional view in the direction of width of the foot is shown in the embodiment, the present invention is not limited thereto. In the present invention, the first reinforcement portion and the second reinforcement portion may have a substantially V-shape projecting downward, a bracket shape, or an inverted trapezoidal shape.

Though the embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. A sole structure for shoes comprising:

a midsole; and a plate member made of a hard resin harder than the midsole, wherein the plate member is joined to a lower surface of the midsole, the plate member including a first reinforcement portion extending rearwardly from a position corresponding to a thenar of a user or a portion in rear of the thenar along a medial side arch and a second reinforcement portion extending rearwardly on a lateral side from the position corresponding to the thenar of the user or the portion in the rear of the thenar so as to avoid a position corresponding to a portion more frontward than a center of a fifth metatarsal bone.

2. A sole structure for shoes comprising:

a midsole; and a plate member made of a hard resin harder than the midsole, wherein the plate member is joined to a lower surface of the midsole, the plate member including a first reinforcement portion extending from a position corresponding to a first metatarsal bone caput of a user or a portion in rear of the first metatarsal bone caput along a medial side arch at least to a position corresponding to a navicular and a second reinforcement portion extending from the position corresponding to the first metatarsal bone caput of the user or the portion in the rear of the first metatarsal bone caput at least to a position corresponding to a cuboid so as to avoid a position corresponding to a portion more frontward than a center of a fifth metatarsal bone.

3. The sole structure for shoes according to claim 1, wherein the first reinforcement portion and the second reinforcement portion each have a U-shape or a V-shape projecting downward in a cross-sectional view in a direction of width of a foot.

4. The sole structure for shoes according to claim 2, wherein the first reinforcement portion and the second reinforcement portion each have a U-shape or a V-shape projecting downward in a cross-sectional view in a direction of width of a foot.

5. The sole structure for shoes according to claim 1, wherein a height difference between a highest point and a lowest point in a prescribed cross-sectional view of the first reinforcement portion in a direction of width of a foot is not smaller than 2 mm, and a height difference between a highest point and a lowest point in a prescribed cross-sectional view of the second reinforcement portion in the direction of width of the foot is not smaller than 2 mm.

6. The sole structure for shoes according to claim 2, wherein a height difference between a highest point and a lowest point in a prescribed cross-sectional view of the first reinforcement portion in a direction of width of a foot is not smaller than 2 mm, and a height difference between a highest point and a lowest point in a prescribed cross-sectional view of the second reinforcement portion in the direction of width of the foot is not smaller than 2 mm.

7. The sole structure for shoes according to claim 1, wherein the plate member further includes a third reinforcement portion provided between the first reinforcement portion and the second reinforcement portion and connecting a lateral side end portion of the first reinforcement portion and a medial side end portion of the second reinforcement portion to each other.

8. The sole structure for shoes according to claim 2, wherein the plate member further includes a third reinforcement portion provided between the first reinforcement portion and the second reinforcement portion and connecting a lateral side end portion of the first reinforcement portion and a medial side end portion of the second reinforcement portion to each other.

9. The sole structure for shoes according to claim 7, wherein the third reinforcement portion is in a form of a flat surface and has an upper surface bonded to the lower surface of the midsole.

10. The sole structure for shoes according to claim 8, wherein the third reinforcement portion is in a form of a flat surface and has an upper surface bonded to the lower surface of the midsole.

11. The sole structure for shoes according to claim 1, wherein the plate member has front and rear end portions joined to respective outsoles that come in contact with a road surface.

12. The sole structure for shoes according to claim 2, wherein the plate member has front and rear end portions joined to respective outsoles that come in contact with a road surface.

* * * * *